US005857225A

United States Patent [19]

Bischoff et al.

[11] Patent Number: 5,857,225

[45] Date of Patent: Jan. 12, 1999

[54] WALL-MOUNT ROD FOR HAND SHOWER

[75] Inventors: Bernd Bischoff, Hemer; Bruno Heimann, Fröndenberg, both of Germany

[73] Assignee: Friedrich Grohe AG, Hemer, Germany

[21] Appl. No.: 986,955

[22] Filed: Dec. 8, 1997

[30] Foreign Application Priority Data

Feb. 12, 1997 [DE] Germany ..... 19705284

[51] Int. Cl.[6] ..... A47K 3/22

[52] U.S. Cl. ..... 4/605; 248/205.1

[58] Field of Search ..... 4/570, 605, 615; 248/205.1, 231.91

[56] References Cited

U.S. PATENT DOCUMENTS 5,265,833 11/1993 Heimann ..... 248/75
5,318,263 6/1994 Bischoff et al. ..... 248/220.2

FOREIGN PATENT DOCUMENTS 643115 5/1964 Belgium .
1370713 7/1964 France .
2124717 9/1972 France .
3906742 9/1990 Germany .
4124353 1/1993 Germany .

*Primary Examiner*—Robert M. Fetsuga
*Attorney, Agent, or Firm*—Herbert Dubno; Andrew Wilford

[57] ABSTRACT

A rod assembly for mounting a hand shower on a wall has a rod extending along a vertical rod axis, having axially opposite upper and lower ends, and formed adjacent one of the ends with a diametrally throughgoing hole and respective upper and lower substantially identical brackets each formed with a vertical inner end face adapted to lie flatly against the wall, a vertically throughgoing passage through which the respective end of the rod extends, and a horizontally throughgoing stepped bore having a narrow inner portion opening at the inner end face and a wide outer portion opening at the respective passage. One of the stepped bores is aligned with the rod hole. Respective upper and lower screws each have a narrow shank extending through the respective narrow bore portion into the wall and a wide head. One of the wide heads bears directly on the respective bracket between the rod and the respective inner end face. The other of the wide heads bears radially on the rod at the hole and retains same axially in the respective passage.

13 Claims, 6 Drawing Sheets

FIG. 4
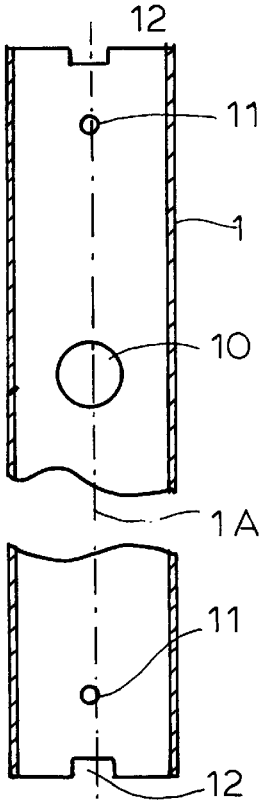
FIG. 3
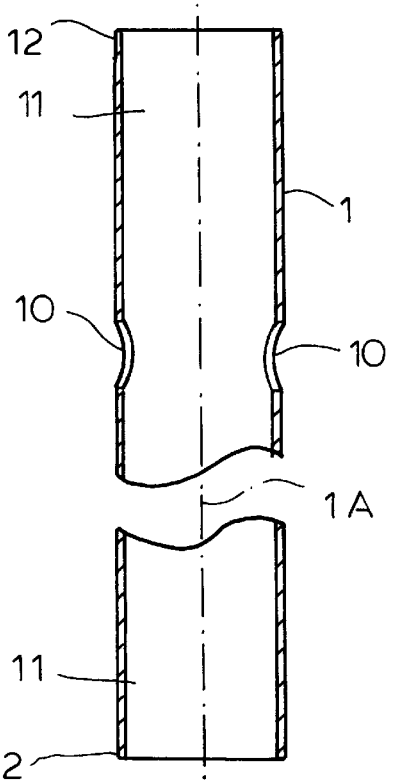
FIG. 6
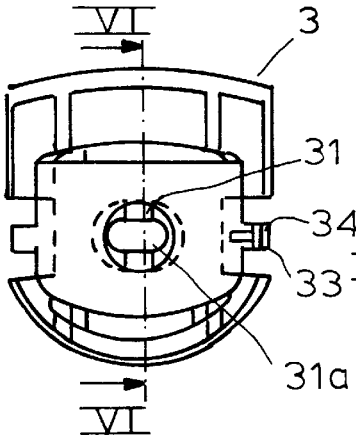
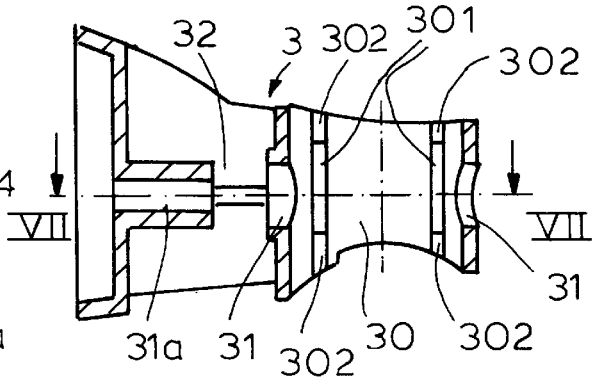
FIG. 5
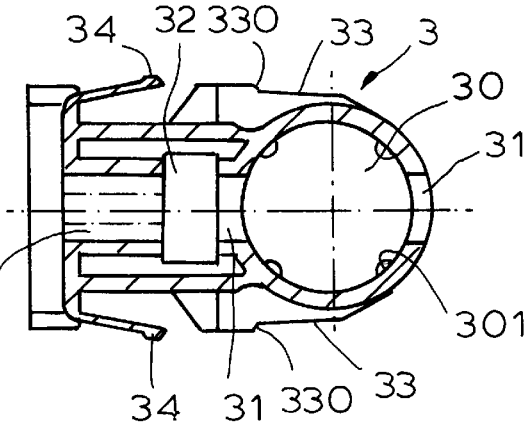
FIG. 7

FIG. 8
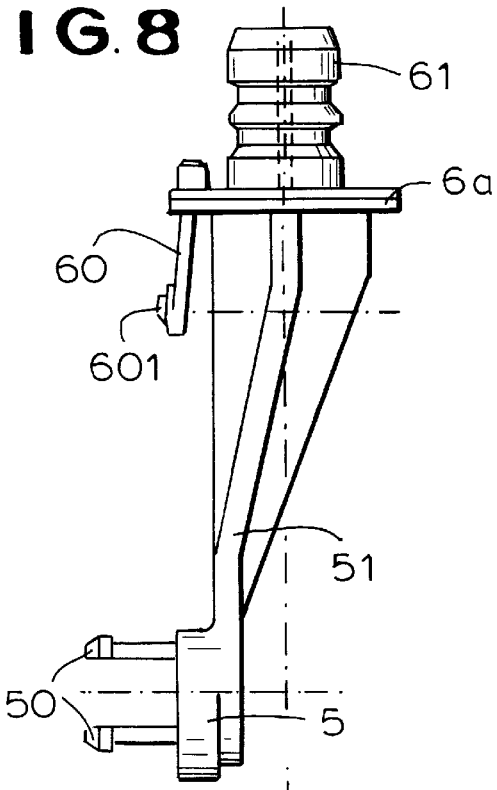
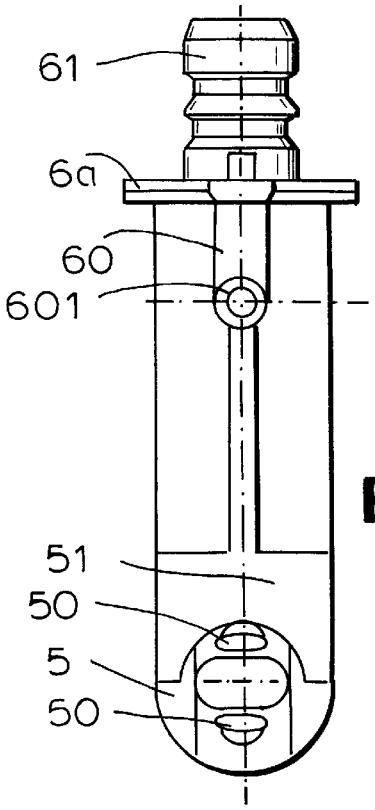
FIG. 9
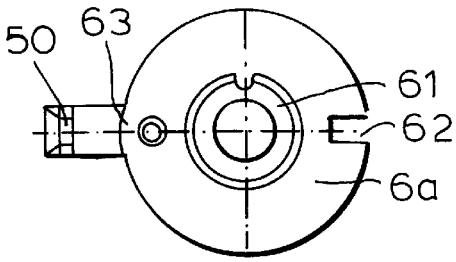
FIG. 10
FIG. 13
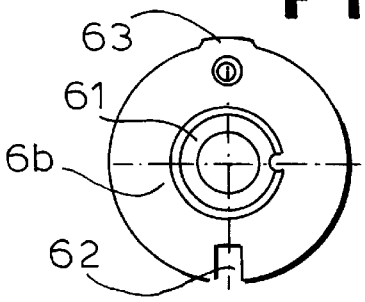
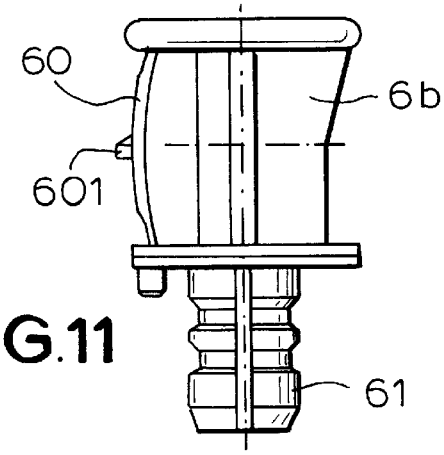
FIG. 11
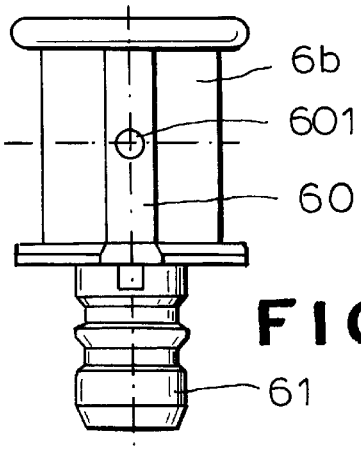
FIG. 12

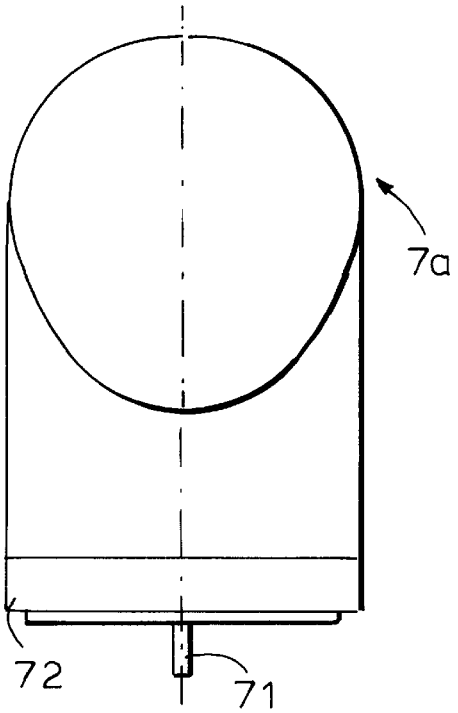
FIG. 15
FIG. 14
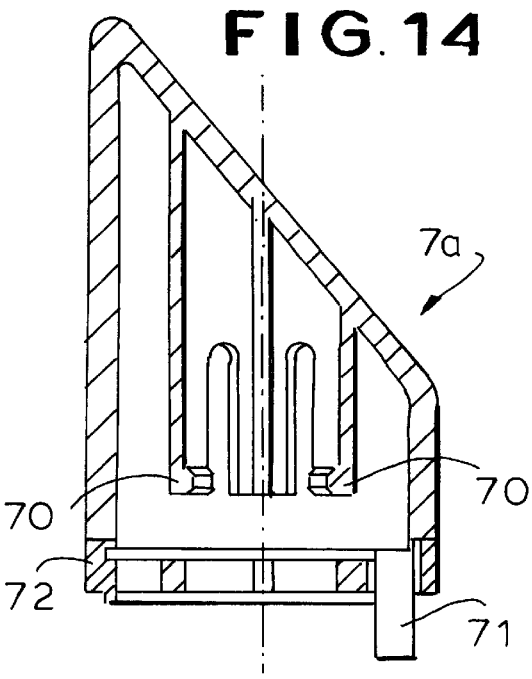
FIG. 16
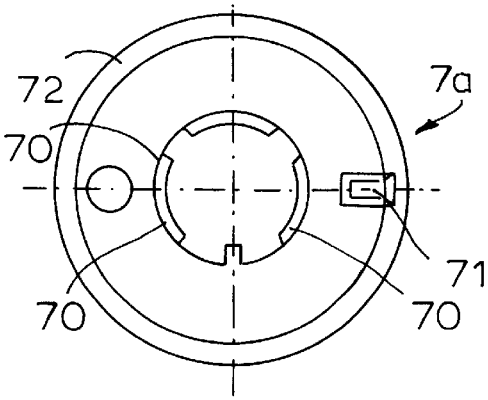
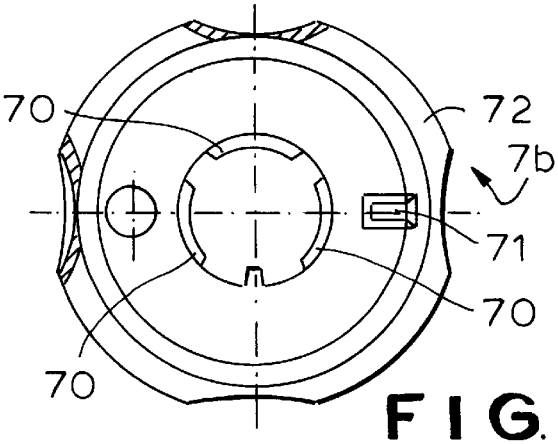
FIG. 19
FIG. 17
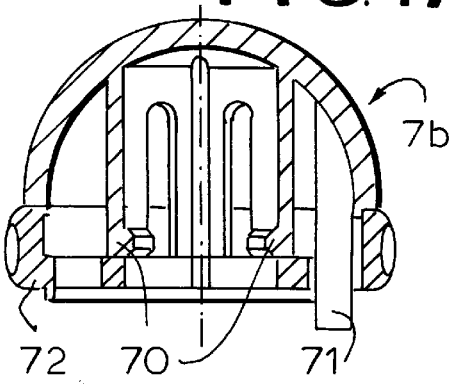
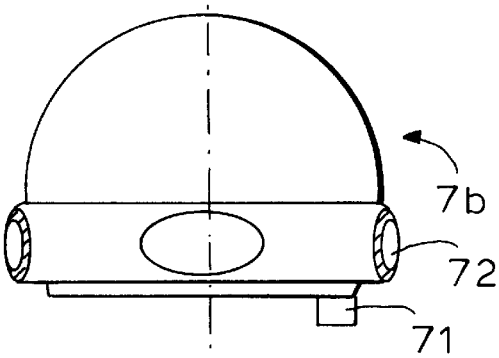
FIG. 18

FIG. 22
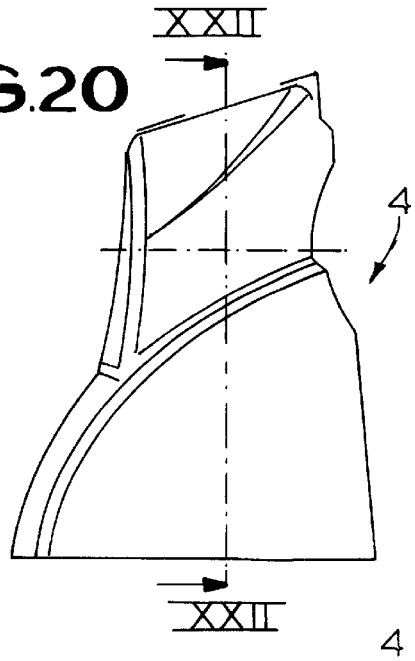
FIG. 20
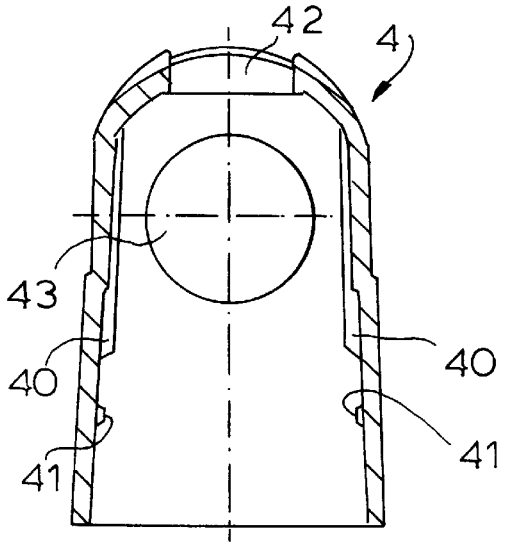
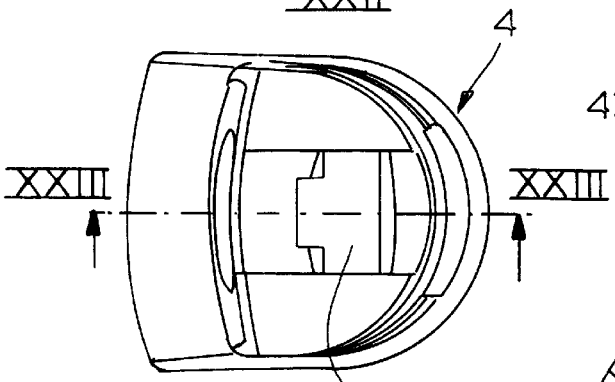
FIG. 21
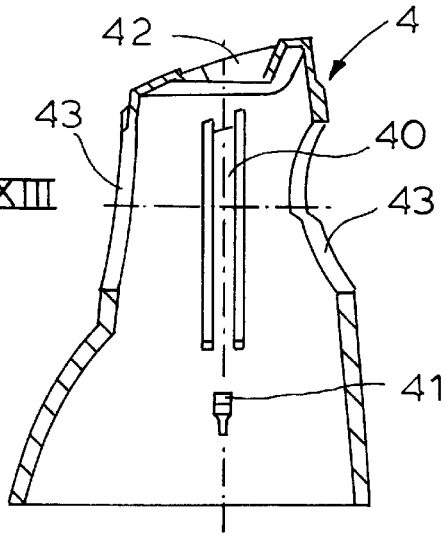
FIG. 23
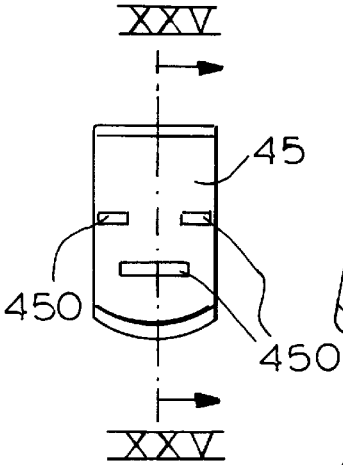
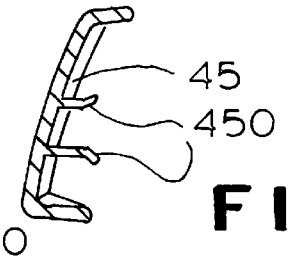
FIG. 25
FIG. 24
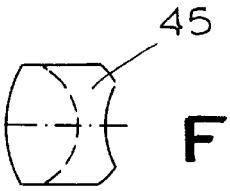
FIG. 26

WALL-MOUNT ROD FOR HAND SHOWER

FIELD OF THE INVENTION

The present invention relates to a wall-mount rod for a hand shower.

BACKGROUND OF THE INVENTION

It is standard to mount a hand shower on a vertical wall-mounted rod for stationary use of the hand shower. Normally a releasable clamp is provided for moving the hand shower up and down on the rod to adjust its vertical position.

Commonly owned U.S. Pat. No. 5,318,263 describes a rod assembly for mounting a hand shower on a wall that has an elongated rod formed at each end with a transversely throughgoing and laterally closed hole and respective holder bodies each formed with a seat in which the respective end of the rod is complementarily engageable. Each body is formed with a passage alignable with the hole of the respective rod end when same is fitted thereto. Respective screws engageable through the aligned holes and passages of the rod and bodies with the wall secure the rod to the bodies and the bodies to the wall.

This system is used with a hand shower having a support stem and mounting bracket of the type described in commonly owned U.S. Pat. No. 5,265,833. This mounting bracket for a hand shower having a support stem has a support adapted to be fixed to the wall-mount rod, a holder formed with a forked seat shaped to receive the hand-shower stem, and interengaging formations on the holder and support for pivoting of the holder on the support about a normally horizontal axis while retaining the holder and support against relative axial movement. An array of radially extending ridges formed on the support, surrounding the axis, and projecting toward the holder engage with complementary ridges formed on a flange of a retaining element rotationally coupled to the holder. A locking bolt axially fixed in the support axially presses the retaining-element ridges against the support ridges so that the holder can be pivoted about the axis on the support with elastic deformation of the flange.

Thus with this system the rod can be solidly mounted on the wall without the mounting screws being visible. In addition prior to installation the assembly is a stable rigid structure that is easy to handle. It furthermore can be disassembled fairly easily, for instance, to add a soap-dish fixture to the rod.

The initial installation of such a rod assembly is fairly tricky however. Two holes must be formed in a wall, often using a masonry bit on ceramic tile, at an exact vertical spacing from each other and one vertically directly above the other. If either of the holes is slightly off, the installation will not work.

OBJECTS OF THE INVENTION

It is therefore an object of the present invention to provide an improved rod assembly for mounting a hand shower or the like on a wall.

Another object is the provision of such an improved rod assembly for mounting a hand shower or the like on a wall which overcomes the above-given disadvantages, that is which is relatively easy to install yet which is very solidly mounted once installed.

SUMMARY OF THE INVENTION

A rod assembly for mounting a hand shower on a wall has according to the invention a rod extending along a vertical rod axis, having axially opposite upper and lower ends, and formed adjacent one of the ends with a diametrally throughgoing hole and respective upper and lower substantially identical brackets each formed with a vertical inner end face adapted to lie flatly against the wall, a vertically throughgoing passage through which the respective end of the rod extends, and a horizontally throughgoing stepped bore having a narrow inner portion opening at the inner end face and a wide outer portion opening at the respective passage. One of the stepped bores is aligned with the rod hole. Respective upper and lower screws each have a narrow shank extending through the respective narrow bore portion into the wall and a wide head. One of the wide heads bears directly on the respective bracket between the rod and the respective inner end face. The other of the wide heads bears radially on the rod at the hole and retains same axially in the respective passage.

Thus with this system the rod is held against radial forces by both brackets but is only anchored against axial movement in one of the brackets. Since axial forces are modest there is no disadvantage to this style of mounting, but it has the advantage that it makes exactly vertical spacing the two brackets unimportant, as one of the brackets can slide axially along the rod and be secured at any convenient level.

The rod hole according to the invention is wider than the wide head of the respective screw. In this case the assembly further has a washer compressed radially between the rod at the hole and the other of the wide heads. The rod is tubular and a plug is engaged in the one rod end and formed with a tongue extending axially in the tubular rod and formed with the washer, and an attachment stem projecting axially from the one rod end. A cap is releasably secured over the stem of the plug.

The washer in accordance with the invention is provided with retaining fingers engaging through the hole and into the wide outer bore portion with the respective bracket. Each bracket is formed in the respective passage with a plurality of radially inwardly projecting, angularly spaced, and axially extending ribs radially compressed against the respective rod end.

The passages according to the invention can be of a cross-sectional shape slightly different from a cross-sectional shape of the rod and rod is limitedly elastically deformably to fit tightly in the passages.

The rod assembly in accordance with the invention further has respective upper and lower substantially identical covers fitting over the respective brackets and formed with respective passages through which the rod passes. Elastically deformable interengaging formations on the covers and brackets retain the covers on the brackets with the respective passages aligned with each other. Each cover is formed on line with the bore of the respective bracket with a window and is provided with a removable cap normally engaged over and covering the respective window.

The rod assembly also has according to the invention respective upper and lower plugs fitted in the ends of the rod. The rod is formed with respective upper and lower radially inwardly open cutouts adjacent the respective ends and each plug is provided with a radially deflectable formation engaged in the respective cutout and retaining the respective plug in the rod. In addition the rod is formed with respective upper and lower axially open notches at the respective ends and each plug is formed with a radially projecting tab complementarily engaged in the respective notch. Each plug has an axially outwardly extending stem and respective upper and lower decorative caps are engaged over the respective stems. Elastically deformable interengaging formations on the caps and stems retain the caps on the respective stems. A metallic decor ring can be provided between each of the plastic caps and the respective plug.

BRIEF DESCRIPTION OF THE DRAWING

The above and other objects, features, and advantages will become more readily apparent from the following description, reference being made to the accompanying drawing in which:

FIGS. 3 and 4 are longitudinal sections 90° offset from each other through the rod of the assembly of this invention;

FIG. 5 is an end view of one of the mounting brackets according to the invention;

FIG. 6 is a section taken along line VI—VI of FIG. 5;

FIG. 7 is a section taken along line VII—VII of FIG. 6;

FIGS. 8, 9, and 10 are side, back, and top views of the upper end plug according to the invention;

FIGS. 11, 12, and 13 are side, back, and bottom views of the lower end plug according to the invention;

FIG. 14 is a detail sectional view of the top cap of the rod assembly;

FIGS. 15 and 16 are front and bottom views of the top cap;

FIG. 17 is a detail sectional view of another top cap according to the invention;

FIGS. 18 and 19 are partly sectional side and bottom views of the cap of FIG. 17;

FIGS. 20 and 21 are side and end views of the bracket cover according to the invention;

FIG. 22 is a section taken along line XXII—XXII of FIG. 20;

FIG. 23 is a section taken along line XXIII—XXIII of FIG. 21;

FIG. 24 is a back view of the cover cap for the cover of FIG. 20;

FIG. 25 is a section taken along line XXV—XXV of FIG. 24; and

FIG. 26 is a top view of the cap of FIG. 24.

SPECIFIC DESCRIPTION

Figure 1:
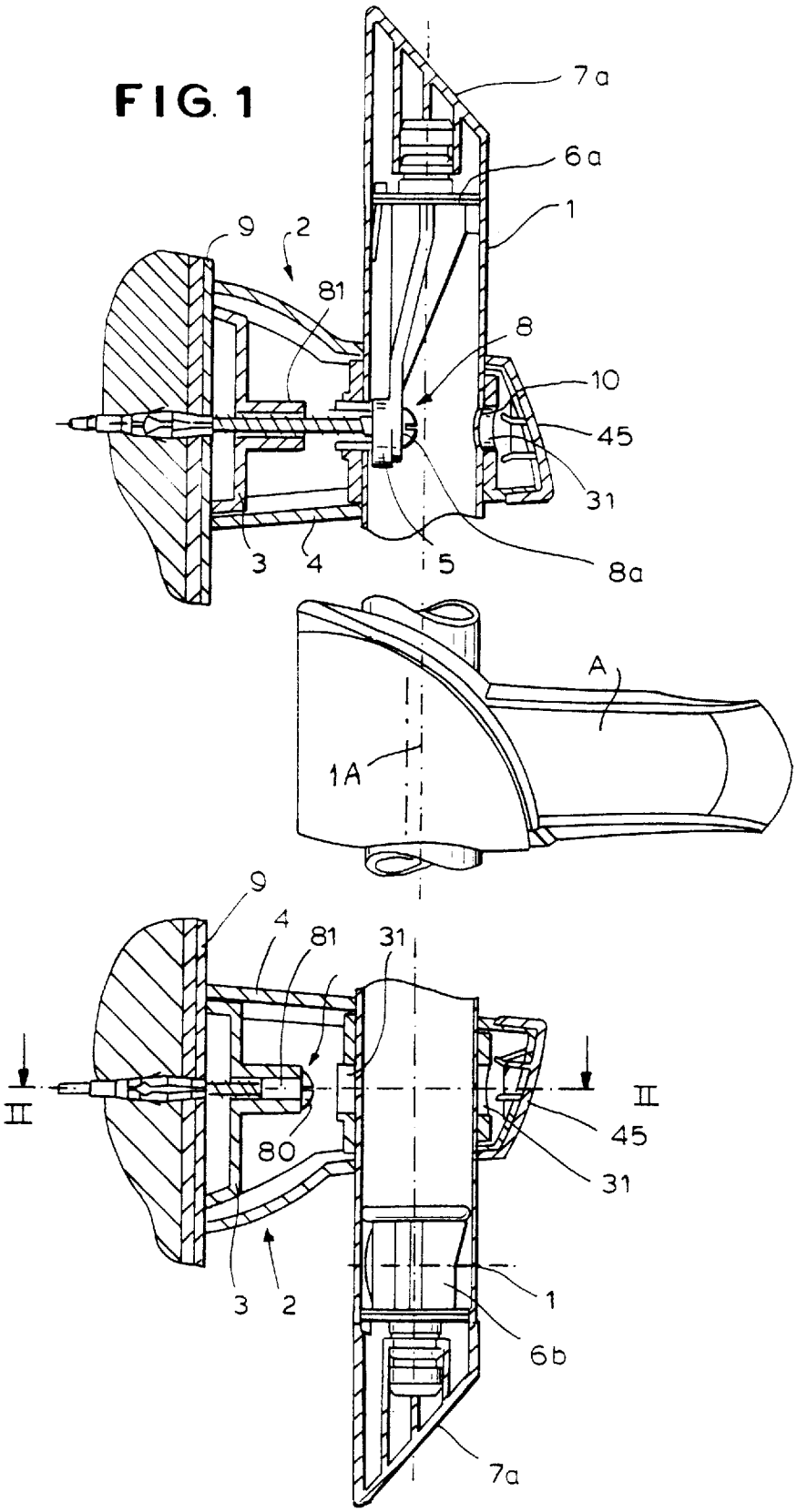
FIG. 1 is a side view partly in vertical section through the rod assembly according to the invention.

As seen in FIG. 1 a rod assembly comprises a vertical rod or tube 1 centered on a vertical rod axis 1A and secured to a wall 9 by two upper and lower bracket subassemblies 2 each comprised of a bracket 3 fixed in place by a screw 8 or 8*a* and a cover 4. The brackets 3 and covers 4 are identical and are normally made of a durable synthetic resin while the rod 1 is a metallic tube. A holder A for a hand shower can be slid along the rod 1, twisted about its axis 1A, and arrested at any location therealong in the manner well known in the art as described above with reference to U.S. Pat. No. 5,265,833.

As also shown in FIGS. 5 through 7, each bracket 3 is formed with a cylindrical throughgoing passage 30 and therein with four angularly equispaced, axially extending, and radially inwardly projecting ribs 301 with chamfered ends 302. These ribs 301 grip the outer surface of the tube 1 solidly with modest deformation so that the tube 1 cannot move in the bracket 3. Alternately the cross-sectional shape of the holes 30 could be slightly different, e.g. oblong, from that of the rod 1 to ensure a tight fit.

Figure 2:
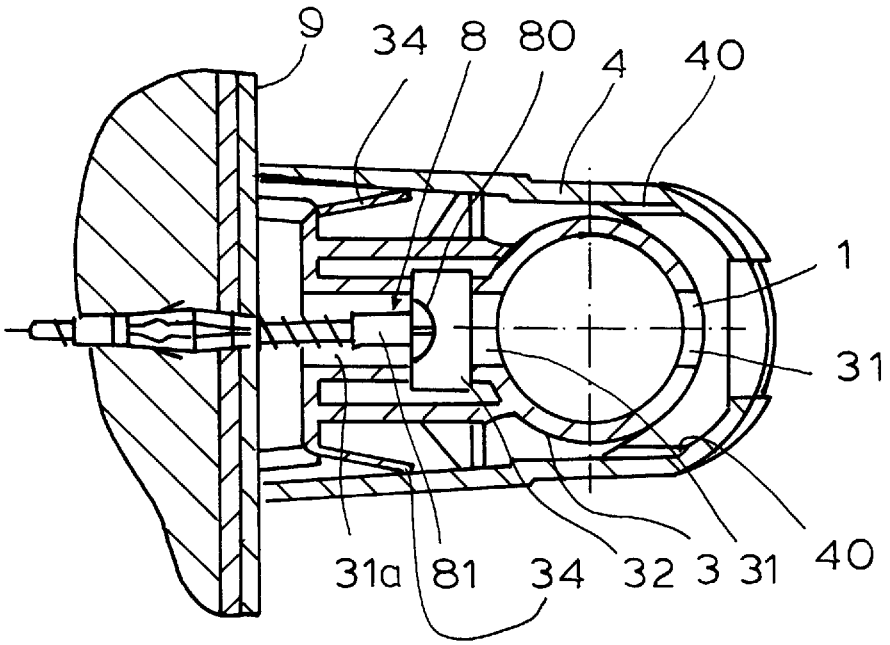
FIG. 2 is a section taken along line II—II of FIG. 1.

Each bracket 3 is unitarily formed with a hole 32 having an outer portion 31 of a diameter greater than that of a head 80 of the respective screw 8 or 8*a* and immediately therebehind with a small-diameter inner portion 31*a* of a vertical width equal to slightly more than that of a shaft 81 of the screw 8 or 8*a*. The outer wide portion extends through the passage 30 so that the screw 8 or 8*a* can be inserted through the outer portion 31 into the inner portion 31*a* and then into the wall 9. The head 80 of the lower screw 8*a* bears as shown at the bottom of FIG. 2 directly on the bracket 3 at the end of the inner portion 31*a* while still leaving some possibility of horizontal adjustment of the lower bracket 3 relative to its screw 8.

In addition each bracket 3 is formed with a pair of side ribs 33 having outwardly directed shoulders 330 and with a pair of elastically deflectable holding fingers 34. The decor cap 4 as shown in FIGS. 20 through 26 is formed with ribs 40 that fit with the ribs 33 and with a retaining nose 41 that catches on the fingers 34 to hold it in place. This cap 4 is formed with a cylindrical throughgoing passage 43 that aligns with the respective passage 30 so that the rod 1 can pass through it, and with an end slot 43 that is normally closed by a cap 45 held in place by elastic retaining tabs or fingers 450.

The upper and lower ends of the tube 1 are closed by end plugs 6*a* and 6*b* that are in turn covered by decorative plastic caps 7*a* and 7*b*. The plug 6*a* as shown in FIGS. 8 through 10 has an upwardly projecting radially grooved pin 61 and a downwardly extending tongue 51. A washer 5 formed at the lower end of the tongue 51 has barbed prongs or fingers 50 adapted to fit through a hole 10 (FIGS. 4 and 5) in the tube 1 and latch in the wide outer portion 31 of the bore 32 of the bracket 3. In addition the plug 6*a* is formed with a deflectable arm 60 having on its end a button 601 that can engage in a hole 11 (FIGS. 4 and 5) of the tube 1 to retain this element 6*a* in place. A radially projecting tab 63 on the plug 6*a* engages in an end notch 12 of the tube 1 to maintain the angular position of the plug 6*a*.

The lower plug 6*b* shown in FIGS. 11 through 13 is formed similarly to the plug 6*a* but does not have the tongue 51. It is adapted to be forced into the lower end of the tube 1 to be held in place purely by the button 601.

The upper and lower end caps 7*a* are identical as shown in FIGS. 14 through 16. Each has a 45° angled end and a metal mounting ring 72. An annular array of axially extending fingers 70 are positioned to grip the respective grooved pin 61 and an axially extending pin 71 projects into a slot 62 (FIGS. 12 and 13) of the plug 6*a* or 6*b* to maintain the angular position of the caps 7*a* and 7*b*. FIGS. 16 through 19 show another type of end cap 7*b* which has a part-spherical rounded end but otherwise is identical to the cap 7*a*.

Normally the upper plug 6*a*, upper cap 7*a*, upper bracket 3, and upper cover 4 are mounted on the rod 1 at the factory. The lower plug 6*b* and lower cap 7*b* may similarly be mounted in place at the factory but are separated from the rod 1 for installation.

For installation two holes are drilled in the wall 9 at a predetermined vertical spacing, which can vary somewhat both vertically and even horizontally. Normally these holes are made in the joints between tiles. Then the lower bracket is screwed in place with its screw 8 bearing against the end of the narrow inner bore portion 31*a* as shown in FIG. 1. The tube 1 is then slipped down through it and its bore 32 is aligned with the upper hole in the wall, if necessary repositioning the lower bracket 3 horizontally. Then the upper screw 8*a* is inserted through the hole 10 and the washer 5 to secure the upper bracket 3 and the upper end of the rod 1 in place. Once both brackets 3 are properly mounted, the caps 45 are snapped into place. Thus the rod 1 is retained radially of its axis 1A by both brackets 3 but is only held axially by the upper screw 8*a*. The exact vertical distance between the two brackets 3 is not critical, and the fact that the slots 31*a* are horizontally elongated allows some degree of horizontal adjustability to compensate for site conditions while still mounting the rod 1 perfectly vertically.

We claim:

1. A rod assembly for mounting a hand shower on a wall, the assembly comprising:

a rod extending along a vertical rod axis, having axially opposite upper and lower ends, and formed adjacent one of the ends with a diametrally throughgoing hole;

respective upper and lower substantially identical brackets each formed with a vertical inner end face adapted to lie flatly against the wall, a vertically throughgoing passage through which the respective end of the rod extends, and a horizontally throughgoing stepped bore having a narrow inner portion opening at the inner end face and a wide outer portion opening at the respective passage, one of the stepped bores being aligned with the rod hole; and respective upper and lower screws each having a narrow shank extending through the respective narrow bore portion into the wall and a wide head, one of the wide heads bearing directly on the respective bracket between the rod and the respective inner end face, the other of the wide heads bearing radially on the rod at the hole and retaining same axially in the respective passage.

2. The rod assembly defined in claim 1 wherein the rod hole is wider than the wide head of the respective screw, the assembly further comprising a washer compressed radially between the rod at the hole and the other of the wide heads.

3. The rod assembly defined in claim 2 wherein the rod is tubular, the assembly further comprising a plug engaged in the one rod end and formed with a tongue extending axially in the tubular rod and formed with the washer, and an attachment stem projecting axially from the one rod end; and a cap releasably secured over the stem of the plug.

4. The rod assembly defined in claim 2 wherein the washer is provided with retaining fingers engaging through the hole and into the wide outer bore portion with the respective bracket.

5. The rod assembly defined in claim 1 wherein each bracket is formed in the respective passage with a plurality of radially inwardly projecting, angularly spaced, and axially extending ribs radially compressed against the respective rod end.

6. The rod assembly defined in claim 1 wherein the passages are of a cross-sectional shape slightly different from a cross-sectional shape of the rod and rod is limitedly elastically deformably to fit tightly in the passages.

7. The rod assembly defined in claim 1, further comprising respective upper and lower substantially identical covers fitting over the respective brackets and formed with respective passages through which the rod passes; and means including elastically deformable interengaging formations on the covers and brackets for retaining the covers on the brackets with the respective passages aligned with each other.

8. The rod assembly defined in claim 7 wherein each cover is formed on line with the bore of the respective bracket with a window and is provided with a removable cap normally engaged over and covering the respective window.

9. The rod assembly defined in claim 1 wherein the rod is tubular, the assembly further comprising respective upper and lower plugs fitted in the ends of the rod.

10. The rod assembly defined in claim 9 wherein the rod is formed with respective upper and lower radially inwardly open cutouts adjacent the respective ends, each plug being provided with a radially deflectable formation engaged in the respective cutout and retaining the respective plug in the rod.

11. The rod assembly defined in claim 9 wherein the rod is formed with respective upper and lower axially open notches at the respective ends, each plug being formed with a radially projecting tab complementarily engaged in the respective notch.

12. The rod assembly defined in claim 9 wherein each plug has an axially outwardly extending stem, the assembly further comprising respective upper and lower decorative caps engaged over the respective stems; and means including elastically deformable interengaging formations on the caps and stems for retaining the caps on the respective stems.

13. The rod assembly defined in claim 12, further comprising a decor ring engaged between each cap and the respective plug.

* * * * *